United States Patent [19]

Palmer

[11] Patent Number: 4,628,716

[45] Date of Patent: Dec. 16, 1986

[54] LOCK FOR CONTAINER LID

[75] Inventor: Thomas E. Palmer, Lytham St Annes, England

[73] Assignee: Glasdon Limited, England

[21] Appl. No.: 759,168

[22] Filed: Jul. 26, 1985

[30] Foreign Application Priority Data

Jul. 27, 1984 [GB] United Kingdom ..... 8419259

[51] Int. Cl.[4] ..... E05B 23/00

[52] U.S. Cl. ..... 70/349; 70/164; 70/134

[58] Field of Search ..... 70/162, 163, 164, 345, 70/349, 352, 134

[56] References Cited

U.S. PATENT DOCUMENTS

| | | | |
|---|---|---|---|
| 110,412 | 12/1870 | Willard | 70/134 |
| 227,301 | 5/1880 | Reinhart | 70/345 |
| 491,352 | 2/1893 | Higgins | 70/134 |
| 691,124 | 1/1902 | Fergusson | 70/134 |
| 774,823 | 11/1904 | Birkedal | 70/134 |
| 1,255,106 | 1/1918 | Oltean | 70/134 |
| 1,656,275 | 2/1927 | Hurd | 70/162 |
| 1,846,822 | 2/1932 | Vogt | 70/134 |
| 3,022,408 | 2/1962 | Wagner | 70/345 |

FOREIGN PATENT DOCUMENTS

| | | | |
|---|---|---|---|
| 741133 | 12/1932 | France | 70/345 |

*Primary Examiner*—Gary L. Smith
*Assistant Examiner*—Suzanne L. Dino
*Attorney, Agent, or Firm*—Roylance, Abrams, Berdo & Goodman

[57] ABSTRACT

The disclosure relates to a lock suitable for a refuse bin for securing a cover of the bin to a base of the bin. The lock comprises a body to be mounted on the cover and having a spring loaded projecting plunger to engage the base. The plunger has an inclined cam surface disposed within the body and a key is insertable in the body to engage the cam surface. The key has two spaced longitudinally extending abutments to engage the cam surface in succession to provide an initial and then a final retraction of the plunger. A projection is provided on the lock body adjacent the plunger to engage between the abutments on the key and thereby prevent a simple blade from being used to retract fully the plunger.

11 Claims, 11 Drawing Figures

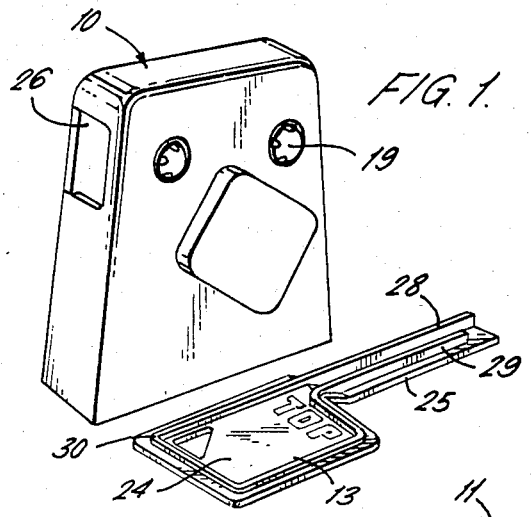
FIG. 1.
FIG. 2.
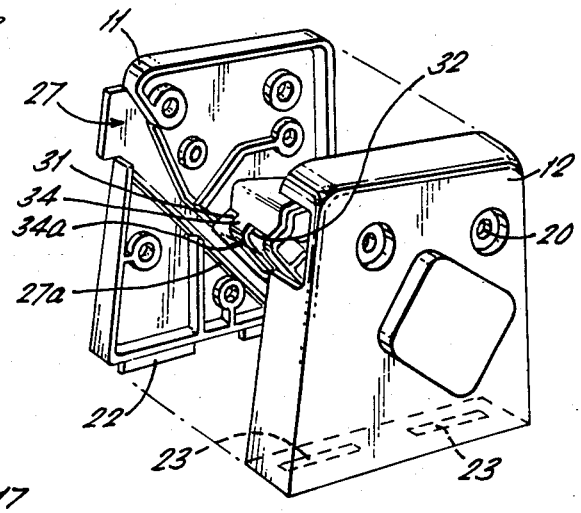
FIG. 3.
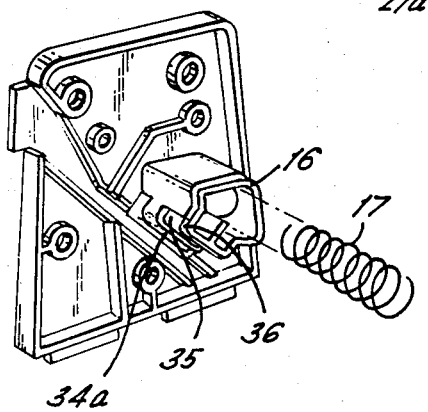
FIG. 4.
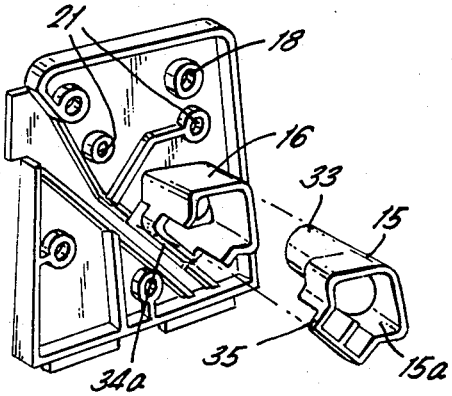

LOCK FOR CONTAINER LID

BACKGROUND OF THE INVENTION

1. Field of the Invention

This invention relates to locks and is particularly although not exclusively applicable to locks for utility articles such as refuse bins which have a lift-off lid or cover within which a refuse container is housed mounted on a base, the lock or locks being provided for securing the cover to the base to prevent unauthorised removal. One such refuse bin is described and illustrated in co-pending U.S. patent application Ser. No. 690,949 filed 14th Jan. 1985 assigned to the Assignees of the current application.

2. Background Prior Art

U.K. Pat. No. 1584072 discloses a locking mechanism having at least one locking bolt adapted for guided linear movement in the housing, the bolt being provided on one longitudinal side with a plurality of spaced teeth, the centre lines of the teeth being at an angle of ten to eighty degrees to each side, a key adapted for guided linear movement through a key hole perpendicular to said bolt and having matching teeth in its side edge at a matching angle, the bolt being arranged to be moved when the teeth of the key are meshed with those of the bolt upon linear movement of the key through the key hole.

U.K. Pat. No. 2066345 discloses a similar lock and key arrangement in which a lock has a housing in which one or two bolts are mounted for sliding movement between a locking position and an un-locked position. Each of the two opposing faces of the bolts has allochirally arranged patterns of alternate lines and groove extending obliquely across the bolts. The housing has a key hole extending therethrough in which the shaft of the key is slidable. Opposite edges of the shaft have alternate lands and grooves complimentary respectively to corresponding lands and groove of latch bolts. To withdraw the bolts, the key is slid inwardly so that successive grooves and lands on it engage successively the corresponding patterns on the bolts to cam them inwardly.

U.K. Pat. No. 1243817 discloses a lockable umbrella holder having a lockable flap provided with locking means consisting of a lock having a slot for receiving a suitable key, a latch bolt slidably mounted in the body of the lock and biassed to an extended position wherein a portion of the latch bolt projects from the body, the latch bolt having a projecting pin which extends into the path of the key in the slot so that when the key is inserted into the slot it engages the pin and so that further depression of the key into the slot causes movement of the pin and thus retraction of the latch bolt from its extended position to release the lock.

U.K. Pat. No. 1243819 shows a modification of the latter arrangement in which the lock comprises a body having a slot for receiving a suitable key, a bolt slidably mounted in the body for movement transverse to the path of the key in the slot and biassed to a position wherein a portion thereof projects from the body, the bolt having a projecting pin extending into the path of the key in the slot enabling a suitable surface of the key to engage the pin and cause movement thereof thus retracting the bolt from its extended position.

All the above locking arrangements rely on relatively complicated components which require to be manufactured to a high degree of precision in order to achieve successful operation. While such arrangements may be satisfactory in clean and dry condition, they would not be satisfactory for use on refuse bins placed in the street and other public places and exposed to dirt, wet and relatively hostile environments.

It is an object of the present invention to provide a lock of relatively simple components which whilst preserving said satisfactory degree of security also is so constructed that dust, dirt and damp are unlikely to impede its operation and which is also capable of relatively cheap and simple manufacture.

SUMMARY OF THE INVENTION

The invention provides a lock having a projecting locking element to effect a locking action with a further component and being retractable in one direction to release the locking action, a key, means to guide the key to move in a second direction transverse to said first direction into engagement with the locking element, the locking element having a ramp thereon for engagement by the key and the key having at least two abutments spaced apart across the key to engage the locking element along lines of action spaced apart respectively in said one direction in which the locking element is movable, the abutments being staggered one behind the other in the second direction of insertion of the key into the lock whereby engagement of one abutment with the ramp on the locking engagement causes a first retraction of the locking element and then engagement of a further abutment with the locking element causes a further retraction of the locking element to release the lock and blocking means being provided for the locking element between the lines of action of the abutments with the locking element to prevent access to the locking element by a single member extending across the lines of action of the two abutments of the key.

Preferably spring means are provided acting on the locking element to urge the element to project from the lock and against which the key acts to retract the locking element.

More specifically, the ramp on the locking element may terminate at an upper end of the ramp nearest the key guide means in a face extending parallel to the direction of movement of the locking element, and, in the fully projected position of the locking element, said upper end of the ramp lies in the path of movement of the most forward of the abutments on the key for initial engagement therewith and a further abutment initially lies opposite said parallel face on the locking element adjacent the ramp, the arrangement being such that said initial retraction of the locking element by the one abutment on the key brings the ramp on the locking element into alignment with the further abutment to effect the further retraction of the locking element.

In any of the above arrangements the locking element may be slidable in a housing to guide the element to move in said one directon and the housing may have slots spaced in said one direction along the housing to receive the abutments on the key to act on the locking element, the part or parts of the housing between the slots providing said blocking means to prevent a blade spanning the width of the key abutments from being inserted in the housing to act on the locking element.

In a further construction the housing or each part of the housing for the locking element between the slots may comprise an upstanding abutment on the side of the housing facing the line of action of the key to provide the blocking means to act between the key abutments.

In any of the above arrangements the key may have two spaced abutments thereon and a single blocking means is provided for the locking element to act between the abutments on the key.

BRIEF DESCRIPTION OF THE DRAWINGS

FIG. 1 is a perspective view of a lock and key for the lock;

FIG. 2 is a perspective view of the lock with the two parts of the casing of the lock separated to reveal the lock mechanism;

FIG. 3 is a detailed view of the back part of the lock casing and the mechanism thereof;

FIG. 4 is an exploded view of part of the lock body and mechanism shown in FIG. 3;

DESCRIPTION OF THE PREFERRED EMBODIMENTS

Figure 5:
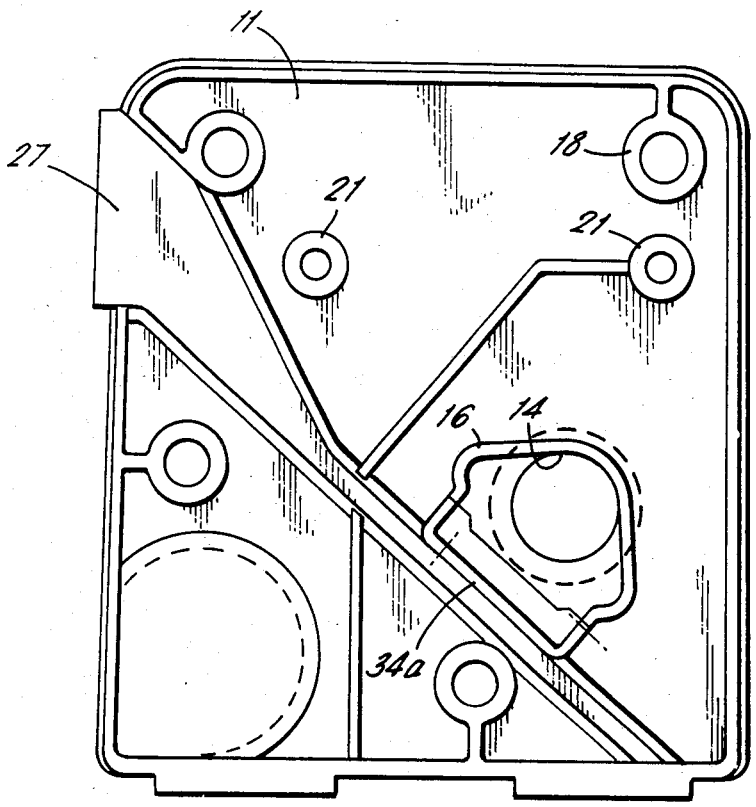
FIG. 5 is an elevation view of the inside of the back part of the casing.
Figure 6:
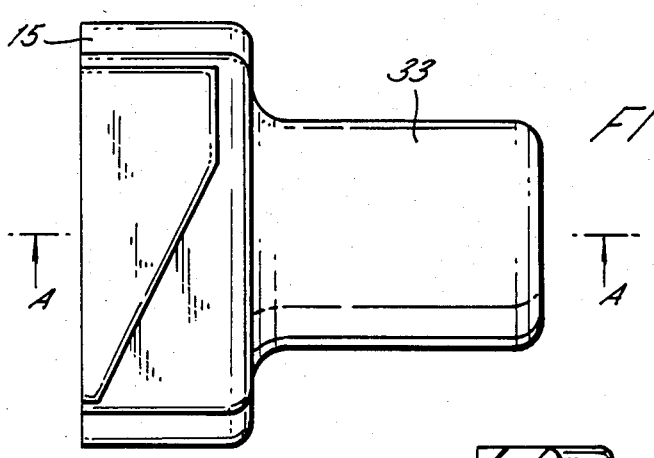
FIGS. 6 to 9 show the retractable plunger of the lock in detail.
Figure 7:
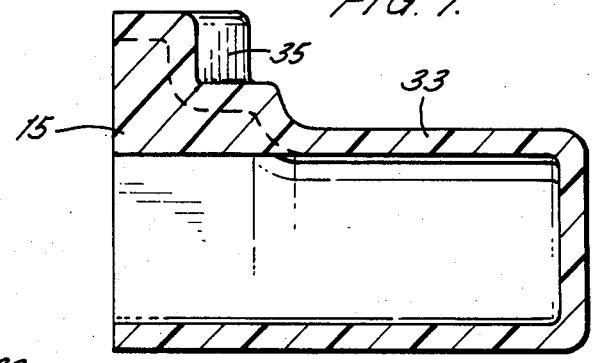
Figure 8:
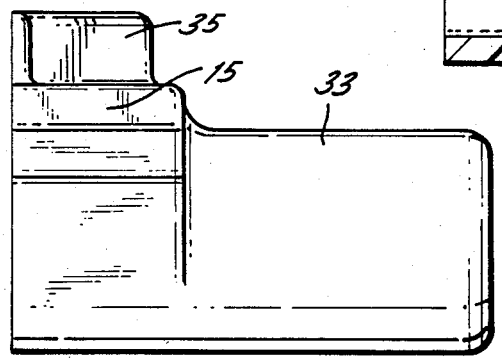
Figure 9:
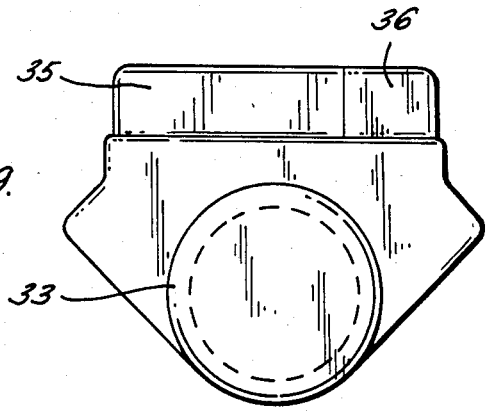
Figure 10:
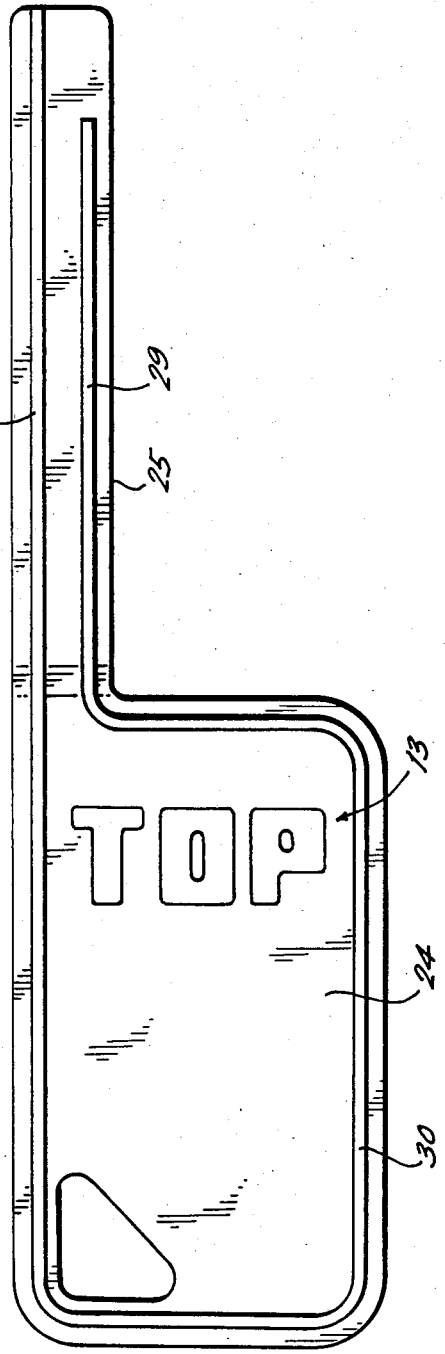
FIGS. 10 and 11 show the key in detail.
Figure 11:
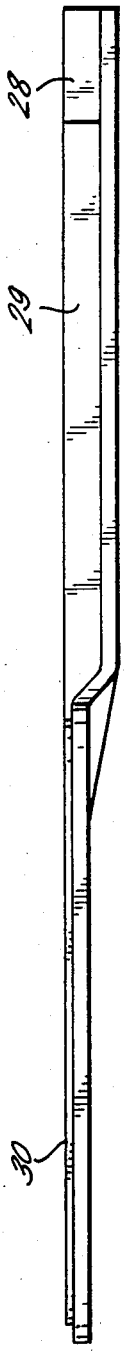

The drawings show a lock particularly intended for use on the refuse bin described and illustrated in our U.K. patent application No. 8400877 for locking the outer casing of the bin to the base of the bin.

As shown in the drawings, the lock comprises a generally square form shallow moulded plastics casing 10 comprising a back plate 11 and a cover 12. A cylindrical plunger 13 projects through an aperture 14 in the back plate and has a head 15 disposed within the lock body slidable in a correspondingly shaped housing 16 formed on the back plate of the body around the aperture 14. A compression spring 17 engages in a seat 15*a* in the head and in a corresponding seat (not shown) on the inside of the cover 12 to urge the cylindrical part of the plunger outwardly of the back of the lock body into locking engagement in a bore in a further component. In the particular example referred to above, the lock body is mounted on the lower edge of the refuse container cover and the base of the container has an aperture to receive the projecting plunger 13 to lock the cover of the body.

The back plate 11 has a number of spaced bosses 18 formed on the inside thereof for receiving fastening devices for fastening the back plate to a wall of the component to which it is to be attached. The cover 12 is secured to the back plate by tamper-proof screws 19 extending through pre-formed counter-sunk apertures 20 in the cover plate, the base plate having bosses 21 to receive the screws. In addition the lower edge of the base plate 11 has downwardly projecting tabs 22 which engage in slots 23 in the lower edge of the cover 12.

The key 13 for operating the lock comprises generally flat form moulding having a rectangular head 24 and an elongate tail 25 to project into the lock. The cover 12 is formed with a rectangular aperture 26 adjacent the upper end of one side edge of the cover to receive the tail of the key. The base plate 11 is formed with a tapering channel indicated at 27 extending down and across the base plate from the key aperture towards the plunger housing 16 to guide the end of the key towards the plunger as it is inserted into the housing.

One side of the key is formed with two ribs 28, 29 which extend along the tail 25 of the key parallel to one another and spaced apart across the tail. One of the ribs 28 extends to the end of the tail whereas the other rib 29 terminates short of the end. At the head of the key, the ribs form a perimeter wall 30 extending around the head spaced inwardly from the periphery of the head.

The key is inserted in the aperture 26 with the ribs 28, 29 facing upwardly and the housing 16 adjacent the upper side of the key channel 27 has parallel slots 31, 32 cut through the wall of the housing adjacent the base plate and the free end of the housing to receive the abutments 28, 29 respectively. A narrow neck 34 of the housing is left between the slots 31, 32 which engages between the abutments 28, 29. The neck 34 serves to block insertion of a single wide blade to act on the plunger instead of the two ribs 28, 29 of key 13. The neck 34 may be truncated (as indicated by the dotted line 34*a*) on FIG. 2 to lie only on the side of the housing facing the line of entry of the key. The tail of the key is supported to guide the abutments 28, 29 through the slots 31, 32 by the wall 27*a*, of the key channel disposed opposite the housing.

The head 15 of the plunger lying in the lower part of the housing 16 in the slots 31, 33 is formed with an inclined ramp face 35 which terminates in a base 36 extending parallel to the axis of the cylindrical projection 34. With the plunger 34 fully extended so that the head 15 abuts the base plate around the aperture 14, the inclined ramp 35 lies in the slot 31 and the face 35 lies in the slot 32. Thus, when the key is inserted in the housing, abutment 28 engages the ramp face 35 and, acting on the ramp, moves the head 15 in a direction to retract the plunger 33. Engagement of the abutment 29 or any other object through the slot 32 on the face 35 have no effect at this stage because the face 35 extends parallel to the direction of movement of the plunger. As the key continues to be inserted in the key channel and the abutment 28 causes the plunger to move in the housing retracting the projection 13, the ramp 35 eventually comes into alignment with the abutment 29 and the abutment 28 will reach the free end of the ramp and cease to have any effect. The abutment 29 then takes over as the key continues to be inserted into the key channel further retracting the plunger until the locking action of the plunger with the other components is released. Eventually the key is fully inserted with the end of the key engaging the bottom edge of the back plate. Thus the plunger is not fully retracted until both abutments 28, 29 have come into engagement with and acted on the ramp. If a single probe is inserted in the key channel into the slot 31 the projecting plunger can be partially retracted only and the components on which the lock is used are so arranged that such partial retraction does not release the lock if the probe is inserted in the other key channel 32, with the projection fully extended, no retraction of the plunger takes place.

It will be appreciated that many modifications may be made to the above described embodiment without departing from the scope of the invention for example the ramp on the projecting plunger may be a form of slot and other forms may be provided for creating the required inter-action between the key and plunger so that the plunger is retracted by a key acting in a direction transverse to the line of action of the plunger.

I claim:

1. A lock having a projecting locking element to effect a locking action with a further component and being retractable in one direction to release the locking action, a key, means to guide the key to move in a second direction transverse to said first direction into engagement with the locking element, the locking element having a ramp thereon for engagement by the key and the key having at least two abutments spaced apart across the key to engage the locking element along lines of action spaced apart respectively in said one direction in which the locking element is movable, the abutments being staggered one behind the other in the second direction of insertion of the key into the lock, engagement of one abutment with the ramp on the locking engagement causes a first retraction of the locking element and engagement of a second abutment with the locking element causes a further retraction of the locking element to release the lock and blocking means being provided for the locking element between the lines of action of the two abutments with the locking element to prevent access to the locking element by a single member extending across the lines of action of the abutments of the key.

2. A lock as claimed in claim 1 wherein spring means are provided acting on the locking element to urge the element to project from the lock and against the action of which the key acts to retract the locking element.

3. A lock as claimed in claim 1 wherein the ramp on the locking element terminates at an upper end of the ramp nearest the key guide means in a face extending parallel to the direction of movement of the locking element and, in the fully projected position of the locking element, said upper part of the ramp lies in the path of movement of the most forward of the abutments on the key for initial engagement therewith and a second abutment initially lies opposite said parallel face on the locking element adjacent the ramp, the arrangement being such that said initial retraction of the locking element by the one abutment on the key brings the ramp on the locking element into alignment with the second abutment to effect the further retraction of the locking element.

4. A lock as claimed in claim 1 wherein the key has two spaced abutments thereon and a single blocking means is provided for the locking element to act between the abutments on the key.

5. A lock as claimed in claim 1 including a lock body from which the locking element projects and having an aperture extending into the body in a direction transverse to the direction of movement of the locking element to receive the key.

6. A lock according to claim 1 wherein said ramp is fixed to said locking element and is directly engaged by said key.

7. A lock according to claim 6 wherein said ramp comprises a cam surface acutely angled relative to said one direction and said second direction.

8. A lock according to claim 1 wherein the key abutments comprise elongated members extending outwardly from a surface of said key.

9. A lock according to claim 1 wherein said ramp is fixed to said locking element and is directly engaged by the key abutments during movement of the locking element.

10. A lock, comprising:

a lock body;

a housing extending across the body;

a locking element slidably mounted in the housing and moveable between a projecting position in which a part of the locking element extends from the lock body and a retracted position in which the locking element is retracted wholly into the lock body;

a key aperture in the lock body and means to guide a key through the body towards the housing containing the locking element, the housing for the locking element having an opening therein and the locking element having a ramp thereon projecting through the opening;

a key for the lock having an elongated member to extend into the lock body and formed with two elongated abutments spaced apart across the elongated member of the key to engage the ramp of the locking element in succession as the key is inserted into the locked body to cause a first retraction of the locking element and then a second retraction of the locking element to retract the locking element into the lock body; and the housing for the locking element having blocking means adjacent the aperture to prevent a blade equivalent in width to the spacing of the key abutments from being inserted through the lock body into engagement with the ramp on the locking element to retract the locking element.

11. A lock as claimed in claim 10 wherein the housing for the locking element between the slots has an upstanding abutment on the side of the housing facing the line of action of the key to provide the blocking means to act between the key abutments.

* * * * *